United States Patent [19]

Lüber

[11] 4,132,260

[45] Jan. 2, 1979

[54] METHOD AND APPARATUS FOR HARDENING OF FOUNDRY CORES

[76] Inventor: Werner Lüber, Bahnhofstrasse 23-32, Bazenheid, Switzerland

[21] Appl. No.: 841,044

[22] Filed: Oct. 11, 1977

Related U.S. Application Data

[63] Continuation of Ser. No. 723,070, Sep. 14, 1976, abandoned.

[30] Foreign Application Priority Data

Oct. 2, 1975 [CH] Switzerland ..... 12818/75

[51] Int. Cl.[2] ..... B22C 9/12

[52] U.S. Cl. ..... 164/16; 164/228

[58] Field of Search ..... 164/12, 16, 159, 228

[56] References Cited

U.S. PATENT DOCUMENTS

| | | | |
|---|---|---|---|
| 3,038,221 | 6/1962 | Hansberg | 164/16 X |
| 3,059,294 | 10/1962 | Dunn et al. | 164/16 X |
| 3,590,902 | 7/1971 | Walker | 164/16 X |
| 3,795,726 | 3/1974 | Zipperer et al. | 164/16 X |
| 3,919,162 | 11/1975 | Austin | 164/12 X |
| 3,937,272 | 2/1976 | Flora et al. | 164/16 X |

FOREIGN PATENT DOCUMENTS

| | | | |
|---|---|---|---|
| 25292 | 7/1973 | Japan | 164/16 |

*Primary Examiner*—Robert L. Spicer, Jr.
*Assistant Examiner*—Gus T. Hampilos
*Attorney, Agent, or Firm*—Flynn & Frishauf

[57] ABSTRACT

It is known to harden foundry cores by admixing a polymerizable material therewith and then curing by addition of a catalyst. Means are provided for injecting gaseous catalysts and compressed air, sequentially, into the die which contains the admixture of polymerizable material and foundry core material. In accordance with the invention, the gaseous catalyst and compressed air respectively, are injected into the die containing the mixture of foundry material in measured desired amounts and very rapidly.

6 Claims, 1 Drawing Figure

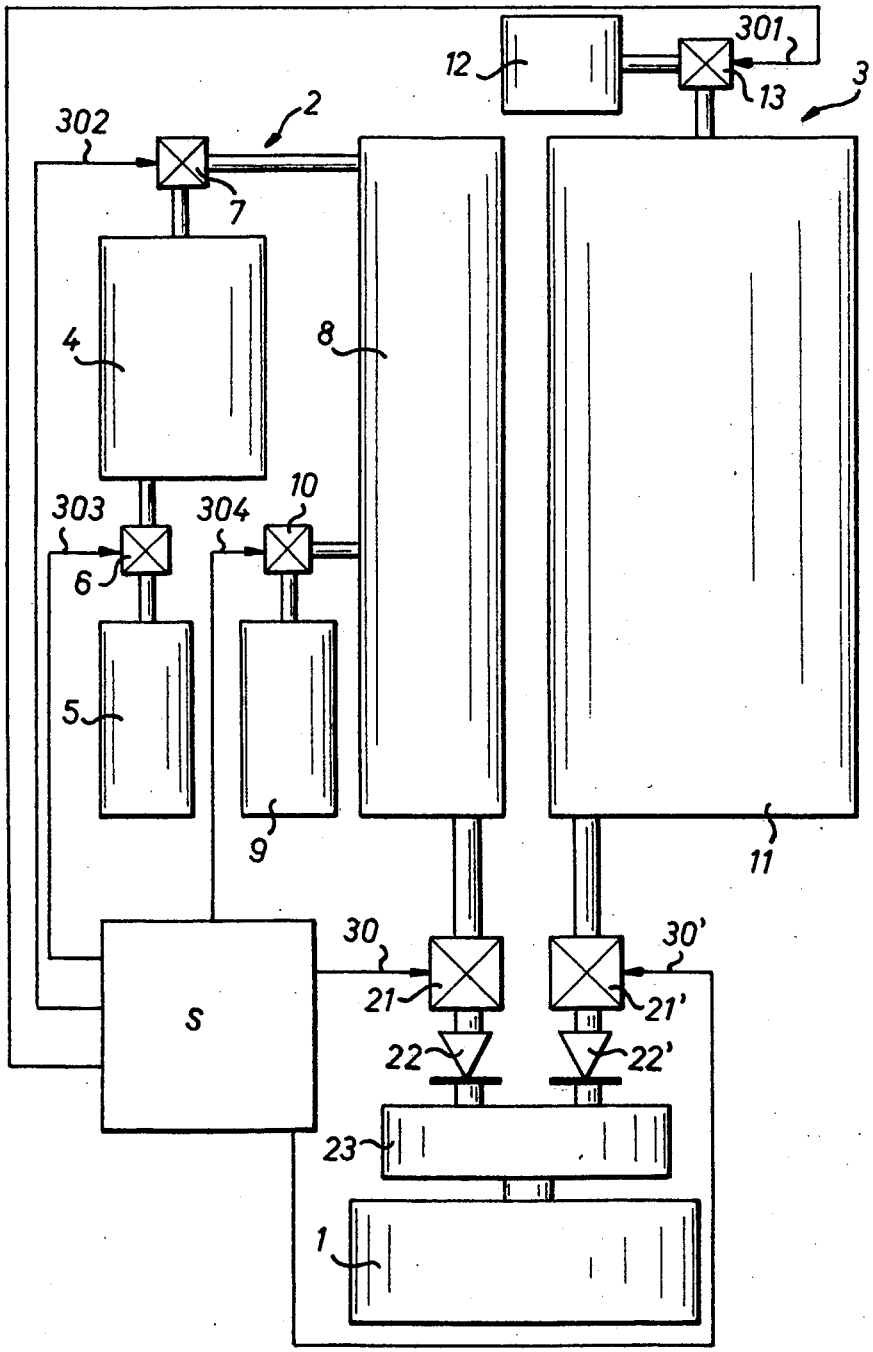
301
12
13
3
2
302
7
4
8
10
303
304
6
5
9
11
30
30'
S
21
21'
22
22'
23
1

METHOD AND APPARATUS FOR HARDENING OF FOUNDRY CORES

This is a continuation of application Ser. No. 730,070, filed Sept. 14, 1976, now abandoned.

The present invention relates to a method to harden foundry cores made of a mixture which includes sand, and an apparatus to carry out the method. More particularly, it relates to such a method and apparatus in which the core is exposed to a mixture of a gaseous catalyst and a carrier gas in a mold or die, and thereafter is exposed to compressed air, in which the volume, pressure and temperature of the mixture and compressed air are controlled.

It has previously been proposed to harden a core made of sand saturated with waterglass, and located in a die, by exposing the core to a stream of $CO_2$ gas. In another method of this type, referred to as the cold box method, two components of an artificial resin system are added to the core sand, the components then hardening in the sand when an alkylamine catalyst is added. One component may, for example, by a polyester resin, a polyether resin, or any suitable liquid resin with a reactive hydroxyl group. The second component, in any event, is an organic isocyanate. Both components are thoroughly mixed with the mold sand and are then shaped. Efforts have been made to catalyze the reaction and to render the use and handling of the alkylamines more reliable.

It has been known for some time that a mixture of tertiary alkylamine and air can be pressed through the isocyanate-sand mixture, while heating the amine-air mixture to a temperature of 30° C. to 50° C. in order to vaporize all the liquid amine. It has also been proposed to use carbon dioxide or nitrogen instead of air as a carrier for the amines. The mold parts to be hardened, in accordance with one apparatus, were placed during any one working step for several times in a closed apparatus, under vacuum, in order to reliably pass the catalyst vapor through all spaces in the die, or form or mold.

All the known processes have a common disadvantage, namely that the hardening process requires a substantial period of time with respect to other working steps. For example, shaping the mixture of molding sand in a die using a core injection machine requires frequently only fractions of a second; the subsequent gas treatment to harden the core, however, requires several seconds. The gas treatment, therefore, is an expensive step. In order to decrease the gas treatment time or, respectively, the hardening time, it has been proposed to apply an excess quantity of amine. This, however, brought the danger that the binder could go back into the solution, thus decreasing the possible final strength of the core to about 80–85%. A decreased final strength of the molded core reduces its resistance against break-up. Cores which have not been completely hardened also cause formation of leafing ribs at the cast element upon subsequent casting thereof.

It has also been proposed to provide measuring pumps between a source of catalyst and the mixing station of carrier gas and catalyst (see German Disclosure Document No. 2,162,137) in order to permit better measured application of the catalyst. The overall solution, however, still was not satisfactory. In other processes, the gaseous catalyst was applied by timed opening and closing of the outlet valves from the source for the gaseous catalyst. In the system proposed in the aforementioned German Disclosure Document, the suction stroke of the pump replaced the previous opening and closing of the outlet valve from the source of the gaseous catalyst. The measured gaseous catalyst, sucked in by the pump, is mixed with the carrier gas immediately before being injected towards the core. The carrier gas was also derived directly from a compressed air source. Using pumps increases the cycling time of the apparatus. Accurate measurements depend on constant temperature conditions as well as on the pressure of the sources for the gaseous catalyst and of the carrier gas. Even if highly accurate valves and valve seats are used, more gaseous catalyst usually was supplied to the core than necessary, since it is practically impossible to maintain the pressure of the sources for gaseous catalyst and compressed air at a uniform, constant level. Again, an excess had to be contended with.

Any structure which requires control elements, pumps, heaters, and the like, in the lines between the sources and the cores, increase the length of the flow paths and thus the injection flow speed of the gaseous catalyst-carrier gas mixture, as well as of subsequent flushing or scavenging air in and to the core. This increases the hardening or curing time, rather than decreasing it.

It is an object of the present invention to provide a method, and an apparatus to carry out the method, in which the above referred-to disadvantages and time delays are decreased or, preferably, entirely eliminated, and which is particularly suitable for decreasing the cycling time of the hardening step.

Subject matter of the present invention: Briefly, temporary measuring vessels are provided for the gaseous catalyst-carrier gas mixture and for compressed air to store the mixture and air, respectively, temporarily; the respective mixture and compressed air are then sequentially injected rapidly, abruptly, suddenly, and explosive like into the core in form of a sudden pulse or blast. The compressed air is stored in a vessel of greater volume and is heated to a higher temperature than the gaseous catalyst-carrier gas mixture.

The invention will be described by way of example with reference to the accompanying drawing, wherein the single FIGURE shows an arrangement to harden foundry cores and utilizing the process of the present application, in highly schematic form.

The apparatus shown in the drawing is intended for cooperation with a core injection machine, and is part thereof. The apparatus is associated with the die 1 of the core injection machine. Apparatus assembly 2 is used to prepare and supply a gaseous catalyst mixture; apparatus assembly 3 is used to prepare and supply heated, compressed air.

The gaseous catalyst mixture prepared in apparatus 2 includes a preparation vessel 4 to which carbonic acid or carbon dioxide is supplied at approximately 2 atm. gauge. Supply to vessel 4 can be derived from a storage container 5 through valve 6. Vessel 4 has placed therein, as known, an amine in liquid form. The amines in the gaseous state will form above its surfaces. The gaseous amine is conducted through valve 7 to a pressure vessel 8. The volume of pressure vessel 8 may be, approximately, 1 liter, or any other suitable quantity in accordance with process control standards or legal requirements. For Germany, the presently legal requirements are that the volume should be such that the gaseous catalyst-carrier gas mixture is capable of accepting a maximum of 25 g tert. alkylamine in vapor form. The medium in vessel 8 is preferably held at about 30° C. The pressure within the vessel 8 can be increased by addition of further gases from a gas supply vessel 9, controlled by a valve 10, in accordance with requirements. This further gas may be a carrier gas, or the carbon dioxide is itself the carrier gas.

The assembly 3 to prepare heated, compressed air has a compressed air vessel 11 of about 10 liters volume including heating means (not shown) to generate compressed air at a temperature of between about 100° C. to 115° C. These heating means may, for example, be electrical heating resistance coils. The air is supplied from a compressed air source 12 over valves 13 and conducted into compressed air vessel 11.

The contents of vessel 8 and of the vessel 11, respectively, can be conducted through respective valves 21, 21', and check valves 22, 22' into the die 1. An interposed distribution or spray head 23 may be used, if necessary. The introduction of the contents from vessel 8 and vessel 11 through the respective valves and spray or distribution head 23 should occur similarly to an explosion, that is, as a sharp, sudden injection pulse.

After forming and shaping of the core in the die 1, for example by injection of the foundry sand mixture into the die, in accordance with well-known and standard practices, valve 21 is opened. Gaseous catalyst from the pressure vessel 8 can then expand through the core sand mixture, as shaped. Immediately thereafter, a shot of hot, compressed air is injected by opening of the valve 21'.

The shot of hot air, in a quantity which is high with respect to that of the catalyst gas mixture, and at a temperature which is substantially higher than that of the catalyst gas mixture, will abruptly increase the temperature of the body of the sand core and thus increase the reaction speed of the curing or hardening process.

It is a simple matter to automate the apparatus for manufacture of cores. A program control unit S, for example of the well-known numerical machine tool control type, controlled by magnetic tape, punch tape, or the like, has control lines 30, 30', 301, 302, 303, 304 extend from the control unit to the valves 21, 21', 13, 7, 6 and 10, respectively, to control in sequential steps the introduction of the respective components from supplies 5, 9 into the vessels 4 and 8 for the catalyst-carrier gas mixture and from supply 12 to vessel 11 for compressed air. A further control line (not shown) or a separate thermostatic control of well known and customary type can be connected to the heating supply for compressed air vessel 11 to maintain the temperature of the compressed air at the desired level.

After the injection of the gaseous catalyst-carrier gas derived from the metering vessel 8, and subsequent curing by injection of heated, compressed air from the compressed air metering vessel 11, the vessels 8 and 11 are re-filled from the respective supplies 4, 12 and, if necessary, auxiliary carrier gas supply 9, to their holding or storage volume at the respective storage conditions.

The method, as well as the apparatus, therefore provided, alternately, a shot of gaseous catalyst-carrier gas mixture and then a shot of heated, compressed air. The quantities of the respective injected gases can be accurately determined by determining the metering volumes of the vessels 8, 11, respectively, so that the respective gases will abruptly expand, as desired, in the core. The closing time of the opening valve 21, 21' thus can be delayed, since only that quantity of the respective gas can reach the core which was previously available from the respective vessel 8, 11 which, as noted, contains an accurately metered quantity.

The respective vessels 8, 11 can be maintained at respective temperatures with great precision and a minimum expenditure of material as well as control elements and control functions. Separating the flow paths for the gaseous catalyst-carrier gas mixture and that for compressed air, and using separate metering holding or storage vessels for each, permits independent temperature control of the respective gases and, specifically, heating of the shot of compressed air to a temperature which is higher by several orders of magnitude than that of the catalyst vapor-carrier gas mixture.

The shot of hot, compressed air permits decreasing the time of the reaction for the curing or hardening process to one-quarter of that previously obtained. Actual practical experience has shown that this substantial reduction in curing time is readily obtainable; the overall timing of the process thus does not throw an entire production schedule out-of-rhythm. This is of primary importancei the manufacture of foundry cores. It appears that this reduction in reaction time is due to the abrupt, sudden increase of the body temperature of the sand core. The extremely high reaction speed permits using a catalyst mixture with very low amine proportion, which is then distributed uniformly about the core form by the shot of hot, compressed air. Subsequently thereto, displacement of the excess catalyst from the core is effected. Entirely apart from the much lower generation of odors, the method results in cores having a practically 100% final strength so that, during the casting process, subsequent hardening will no longer occur and the characteristics of the core, with respect to crumbling after casting, are substantially improved.

The respective vessels 8, 11 temporarily store a predetermined mixture of the respective gases introduced thereto, the storage vessel for the compressed air being substantially larger than that for the gaseous catalyst-carrier gas mixture and also being heated by standard heating means, such as resistance coils, hot-air or steam coils, or the like, so that the compressed air therein will be maintained at a predetermined and elevated temperature, as required by the process.

Various changes and modifications may be made within the scope of the invention concept.

A mold core of 25,000 $cm^3$ volume was to be hardened. Vessel 8, with a volume of 2 liter was filled with gaseous amine, at the temperature of 30° C. and at a pressure of 2 atm gauge. Vessel 11, with a volume of 30 liter was filled with compressed air at a pressure of 8 atm gauge which was heated so that, within the vessel, it had a temperature of 110° C. To cure the mold, which was at ambient air pressure and normal "room" temperature, valve 21 was opened to rapidly inject the gaseous catalyst-and-carrier gas mixture in vessel 8 into the mold; immediately thereafter, valve 21' was opened to inject most suddenly and abruptly the compressed air from vessel 11 into the mold die.

Total time elapsed from first filling the vessels 8, 11, until curing time of the mold:

The relative quantities, pressures, and temperatures of the gasses in the vessels 8, and 11 can readily be determined from operating data well known in the foundry field.

The present invention is specifically directed to optimizing the cure conditions of the mold core under all circumstances, so that, in a repetitive and preferably automated system the cores will all be uniformly and identically cured by introducing thereto, at all times, the optimum quantities, under optimum temperature and pressure conditions of the respective gaseous catalyst mixture and compressed air. Preferably, the pressure of the compressed air should be in excess of that of the gaseous catalyst-carrier gas mixture by 2 to 4 times to insure reliable, and effective flushing, and to provide for rapid curing by thermal shock.

The pressure of the compressed air in Source 12 is preferably in the range of 2 to 4 atm (gauge); the pressure in vessel 11, after the compressed air has been raised to the temperature in the range of about 100°–115° C. is about 10 atm (gauge) at a pressure in the gaseous catalyst-carrier gas mixture in vessel 8 of about 2 atm (gauge). This is an approximate generally suitable pressure relationship valid for customary injection gases. The temperature of the gaseous catalyst-carrier gas mixture in vessel 8 can be at ambient, or "room" temperature, that is, approximately in the order of

I claim:

1. Method of hardening foundry core means made of a mixture which includes sand and curable compounds in which, to harden the core means, the core means is exposed in a core-forming apparatus to a mixture of a gaseous catalyst and a carrier gas, and to compressed air wherein, in order to accurately predetermine the volume, pressure and temperature of the gaseous catalyst-carrier gas mixture being applied to the core means, and of the compressed air being applied to the core means, the method comprises the providing a source (4, 5, 6) of gaseous catalyst-carrier gas mixture;

providing a source (12, 13) of compressed air;

providing a first temporary storage vessel (8) for gaseous catalyst-carrier gas mixture;

supplying said catalyst-carrier gas mixture from said mixture source to said first temporary storage vessel (8);

segregating and temporarily storing a predetermined quantity, which corresponds to the desired amount to cure the core means in the core forming apparatus, of the mixture of gaseous catalyst and carrier gas in the first temporary storage vessel (8);

providing a second temporary storage vessel (11) of substantially greater volume capacity than said first temporary storage vessel (8);

supplying compressed air from said compressed air source to said second temporary storage vessel;

segregating and temporarily storing a predetermined quantity, which corresponds to the desired amount to flush the core means in the core forming apparatus, of compressed air in the second temporary storage vessel (11);

controlling pressure, and the temperature of the compressed air in said second temporary storage vessel to be higher than the pressure and temperature of the gaseous catalyst-carrier gas mixture in said first temporary storage vessel to thereby segregate a controlled larger quantity of compressed air therein;

suddenly and abruptly and rapidly injecting such stored mixture of gaseous catalyst-carrier gas from said first temporary storage vessel into the core means in the core forming apparatus by admitting the segregated, desired quantity of said stored mixture into the core forming apparatus; and then suddenly and abruptly and rapidly injecting said compressed air from said second temporary storage vessel at said elevated temperature and with said higher pressure into the core means in the core forming apparatus by admitting the segregated desired larger quantity of said stored compressed air into the core forming apparatus.

2. Method according to claim 1, wherein the temperature of the catalyst-carrier gas mixture is about 30°–50° C., and the temperature of the compressed air is about 100° to 115° C.

3. Method according to claim 1, wherein the volume of gaseous catalyst-carrier gas mixture is about 1 liter; and the volume of heated, compressed air is about 10 liters.

4. Method according to claim 1, wherein the step of segregating and temporarily storing the mixture gaseous catalyst and carrier gas, comprises segregating a quantity of about 1 liter and storing said quantity, temporarily, at a temperature of about 30° C. in said first vessel (8), and the step of segregating and temporarily storing the compressed air comprises segregating and storing a quantity of about 10 liters of compressed air at a temperature of about 100°–115° C. in said second vessel (11).

5. Method according to claim 1, wherein the step of segregating and temporarily storing the compressed air comprises storing compressed air at a temperature of about 100°–115° C. and at the pressure of 4 to 8, atm gauge and having a volume of about 10 times the volume of the gaseous catalyst-carrier gas mixture at a pressure of said mixture of about 2 atm gauge.

6. A method according to claim 1 wherein, prior to any curing steps, foundry core material is injected into a core-forming apparatus.

* * * * *

UNITED STATES PATENT AND TRADEMARK OFFICE

CERTIFICATE OF CORRECTION

PATENT NO. : 4,132,260

DATED : January 2, 1979

INVENTOR(S) : Werner LUBER

It is certified that error appears in the above–identified patent and that said Letters Patent are hereby corrected as shown below:

Column 5, line 21, after "temperature" delete "that is, approximately in the order of --

Claim 1, column 5, line 32, "the method comprises the providing" should be -- the method comprises the step of providing --

Signed and Sealed this

*First* Day of *May 1979*

[SEAL]

*Attest:*

RUTH C. MASON
*Attesting Officer*

DONALD W. BANNER
*Commissioner of Patents and Trademarks*